US009204499B2

(12) United States Patent
Kim et al.

(10) Patent No.: US 9,204,499 B2
(45) Date of Patent: Dec. 1, 2015

(54) INDUCTION HEATING COOKER AND CONTROL METHOD THEREOF

(75) Inventors: Ha Na Kim, Incheon (KR); Jong Chull Shon, Suwon-si (KR); Sung Ho Lee, Suwon-si (KR); Min Gyu Jung, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 911 days.

(21) Appl. No.: 13/429,738

(22) Filed: Mar. 26, 2012

(65) Prior Publication Data

US 2012/0255946 A1 Oct. 11, 2012

(30) Foreign Application Priority Data

Apr. 8, 2011 (KR) ..... 10-2011-0032614

(51) Int. Cl.
*H05B 6/12* (2006.01)
*H05B 6/06* (2006.01)

(52) U.S. Cl.
CPC ..... *H05B 6/065* (2013.01); *H05B 2213/03* (2013.01); *H05B 2213/05* (2013.01)

(58) Field of Classification Search
CPC ..... H05B 6/065; H05B 2213/05; H05B 2213/03; H05B 6/1263; H05B 6/1272; H05B 2206/022
USPC ..... 219/620–627, 670, 672–676, 660–667
See application file for complete search history.

(56) References Cited

U.S. PATENT DOCUMENTS

2009/0139986 A1 * 6/2009 Lee et al. ..... 219/622

FOREIGN PATENT DOCUMENTS

| | | | |
|---|---|---|---|
| EP | 2034799 | | 3/2009 |
| EP | 2034799 | A1 * | 3/2009 |
| EP | 2068598 | | 6/2009 |
| FR | 2863039 | | 6/2005 |
| WO | 2010/118943 | | 10/2010 |
| WO | WO 2010/118943 | A1 * | 10/2010 |

OTHER PUBLICATIONS

Extended European Search Report issued Aug. 2, 2012 in corresponding European Patent Application No. 12161216.2.

* cited by examiner

*Primary Examiner* — Quang Van
(74) *Attorney, Agent, or Firm* — Staas & Halsey LLP

(57) ABSTRACT

An induction heating cooker and a control method thereof that stably adjust power of a cooking coil when a plurality of containers having different cooking conditions is placed on the cooking coil includes a plurality of heating coils disposed below a cooking plate and a controller to determine whether a container is placed on the heating coils, wherein the controller determines whether a plurality of containers is placed on one of the heating coils and, when the containers are placed on one of the heating coils, adjusts a power of the heating coil on which the containers are placed based on powers of other heating coils occupied by the containers. Cooking using a plurality of containers is stably performed based on user intention even when cooking conditions of the containers placed on a heating coil differ.

20 Claims, 12 Drawing Sheets

INDUCTION HEATING COOKER AND CONTROL METHOD THEREOF

CROSS-REFERENCE TO RELATED APPLICATIONS

This application claims the priority benefit of Korean Patent Application No. 2011-0032614, filed on Apr. 8, 2011 in the Korean Intellectual Property Office, the disclosure of which is incorporated herein by reference.

BACKGROUND

1. Field

The following description relates to an induction heating cooker and a control method thereof that heats a container regardless of where the container is placed on a cooking plate.

2. Description of the Related Art

Generally, an induction heating cooker is a device that supplies high-frequency current to a heating coil to generate a strong high-frequency magnetic field and generates eddy current in a cooking container (hereinafter, referred to as a container) magnetically coupled to the heating coil using the magnetic field to heat the container using Joule heat generated by the eddy current, thereby cooking food.

An induction heating cooker includes a plurality of heating coils fixedly mounted in a main body forming the external appearance thereof to provide a heat source. Also, a cooking plate, on which a container is placed, is disposed at the top of the main body. Container lines are formed at positions of the cooking plate corresponding to the heating coils. The container lines serve to guide positions on which a user places a container to cook food.

When food is cooked using the conventional induction heating cooker, however, a user may have trouble correctly placing a container on the cooking plate at a corresponding one of the container lines so that cooking (i.e. heating of the container) is effectively performed. That is, if the user places the container at a position deviating from the container lines, cooking may not be performed properly.

In recent years, an induction heating cooker has been developed wherein a large number of heating coils is disposed below a cooking plate over the entire surface of the cooking plate so that cooking is effectively performed regardless of where a container is placed on the cooking plate.

In the aforementioned induction heating cooker, a plurality of containers may be placed on one of the heating coils; however, each of the heating coils is operated under a single cooking condition. When cooking conditions of the containers differ, therefore, a user's intention may not be reflected properly.

SUMMARY

It is an aspect to provide an induction heating cooker and a control method thereof that stably adjust a power of a cooking coil when a plurality of containers having different cooking conditions is placed on the cooking coil.

Additional aspects will be set forth in part in the description which follows and, in part, will be obvious from the description, or may be learned by practice of the invention.

In accordance with an aspect, an induction heating cooker includes a plurality of heating coils disposed below a cooking plate and a controller to determine whether a container is placed on the heating coils, wherein the controller determines whether a plurality of containers is placed on one of the heating coils and, when the containers are placed on one of the heating coils, adjusts a power of the heating coil on which the containers are placed based on powers of other heating coils occupied by the containers.

The induction heating cooker may further include current detectors to detect values of current flowing in the respective heating coils, wherein the controller may determine whether a container is placed on the heating coils based on the current values detected by the current detectors.

The controller may control the current detectors to detect the values of current flowing in the respective heating coils at a predetermined time interval and determine whether the containers are placed on one of the heating coils based on change of the values of current flowing in the respective heating coils.

Upon determining that a heating coil having an increased current value is included in the heating coils on which the containers are determined to be placed and that a container is placed on a heating coil neighboring to the heating coil having the increased current value, the controller may determine that a plurality of containers is placed on the heating coil having the increased current value.

The controller may drive the heating coil on which the containers are placed using a smallest one of the powers of the other heating coils occupied by the containers.

The controller may drive the heating coil on which the containers are placed using the average of the powers of the other heating coils occupied by the containers.

The controller may drive the heating coil on which the containers are placed using a second smallest one of the powers of the other heating coils when the container driven using the smallest power is removed.

The induction heating cooker may further include an input unit to allow information on a plurality of containers placed on the cooking plate to be input, wherein the controller may control the current detectors to detect the values of current flowing in the respective heating coils at a predetermined time interval and determine whether the containers are placed on one of the heating coils based on the information on the containers input through the input unit when the containers are placed on one of the heating coils before power-on or when the containers are placed on one of the heating coils within the predetermined time interval.

The information on the containers may include the number, position, or shape of the containers.

The controller may control the input unit to display a position or shape used most frequently according to the number of the containers.

The input unit may allow the information on the containers placed on the cooking plate to be input by a user drag operation.

In accordance with another aspect, a control method of an induction heating cooker, having a cooking plate and a plurality of heating coils, to heat a container regardless of where the container is placed on the cooking plate, includes determining whether a plurality of containers is placed on one of the heating coils and, upon determining that the containers are placed on one of the heating coils, adjusting a power of the heating coil on which the containers are placed based on powers of other heating coils occupied by the containers.

The determining whether the containers are placed on one of the heating coils may include detecting values of current flowing in the respective heating coils at a predetermined time interval and determining whether the containers are placed on one of the heating coils based on change of the detected current values.

The determining whether the containers are placed on one of the heating coils may include, when a heating coil having an increased current value is included in the heating coils on which the containers are determined to be placed and a container is placed on a heating coil neighboring to the heating coil having the increased current value, determining that the containers are placed on the heating coil having the increased current value.

The adjusting the power of the heating coil on which the containers are placed may include driving the heating coil on which the containers are placed using a smallest one of the powers of the other heating coils occupied by the containers.

The adjusting the power of the heating coil on which the containers are placed may include driving the heating coil on which the containers are placed using the average of the powers of the other heating coils occupied by the containers.

The driving the heating coil on which the containers are placed using the smallest one of the powers of the other heating coils occupied by the containers may include driving the heating coil on which the containers are placed using a second smallest one of the powers of the other heating coils when the container driven using the smallest power is removed.

The control method may include allowing information on a plurality of containers placed on the cooking plate to be input and determining whether the containers are placed on one of the heating coils based on the input information on the containers when the containers are placed on one of the heating coils before power-on or when the containers are simultaneously placed on one of the heating coils.

The control method may further include displaying the position or shape used most frequently according to the number of the containers.

The allowing the information on the containers placed on the cooking plate to be input may include allowing the information on the containers placed on the cooking plate to be input by a user drag operation.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
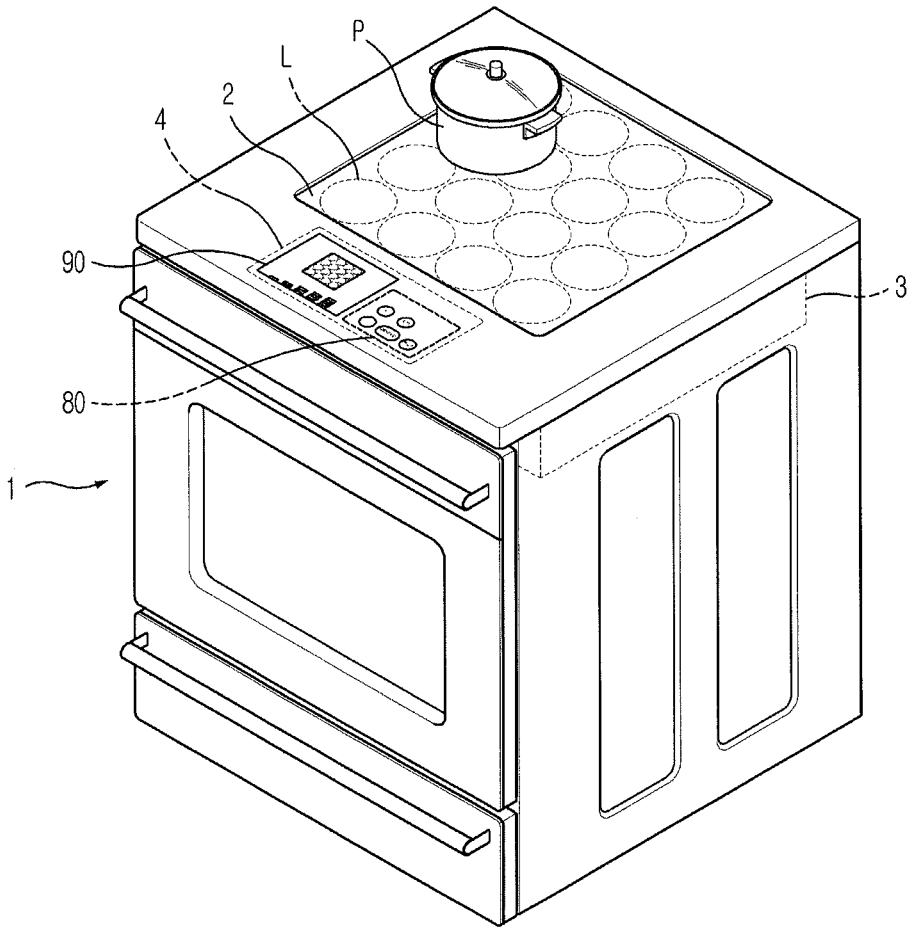
FIG. 1 is a perspective view illustrating the construction of an induction heating cooker according to an embodiment.

Reference will now be made in detail to the embodiments, examples of which are illustrated in the accompanying drawings, wherein like reference numerals refer to like elements throughout.

When food is cooked using an induction heating cooker, an operation to detect a position of a container on a cooking plate (container position detection operation) may be necessary before a cooking operation is commenced after a user places the container on the cooking plate.

To determine a position of the container on the cooking plate, high-frequency current may be supplied to a plurality of heating coils disposed below the cooking plate, values of current flowing in the heating coils may be measured, and which of the heating coils the container is placed on may be determined using the measured current values.

An induction heating cooker according to an embodiment is configured to have a structure in which small heating coils are densely disposed below the entire surface of a cooking plate so that a container containing food to be cooked is heated irrespective of where the container is placed. First, the structure of an induction heating cooker according to an embodiment will be described with reference to FIGS. 1 and 3.

FIG. 1 is a perspective view illustrating the construction of an induction heating cooker according to an embodiment.

As shown in FIG. 1, the induction heating cooker includes a main body 1.

A cooking plate 2, on which a container P is placed, is disposed at the top of the main body 1.

In the main body 1, a plurality of heating coils L is disposed below the cooking plate 2 to supply heat to the cooking plate 2. The heating coils L are disposed below the cooking plate 2 throughout the entire surface of the cooking plate 2 at equal intervals. In this embodiment, 16 heating coils are disposed in a 4×4 matrix.

Figure 3:
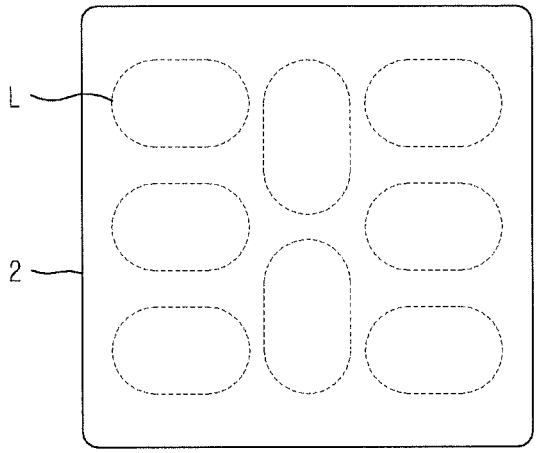
FIG. 3 is a plan view illustrating heating coils of an induction heating cooker according to another embodiment.

Alternatively, the heating coils L may be disposed below the cooking plate 2 throughout the entire surface of the cooking plate 2 at different intervals, in a different configuration, or with a different number of coils. For example, the heating coils L may be disposed as shown in FIG. 3. FIG. 3 is a plan view illustrating heating coils of an induction heating cooker according to another embodiment.

Also, a control device 3 to drive the heating coils L is provided below the cooking plate 2. Circuit constructions of the control device 3 will be described below in more detail with reference to FIG. 2.

Also, a control panel 4, including an input unit 80 having a plurality of manipulation buttons to input commands to drive the heating coils L to the control device 3 and a display unit 90 to display information related to the operation of the induction heating cooker, is provided at the top of the main body 1.

Figure 2:
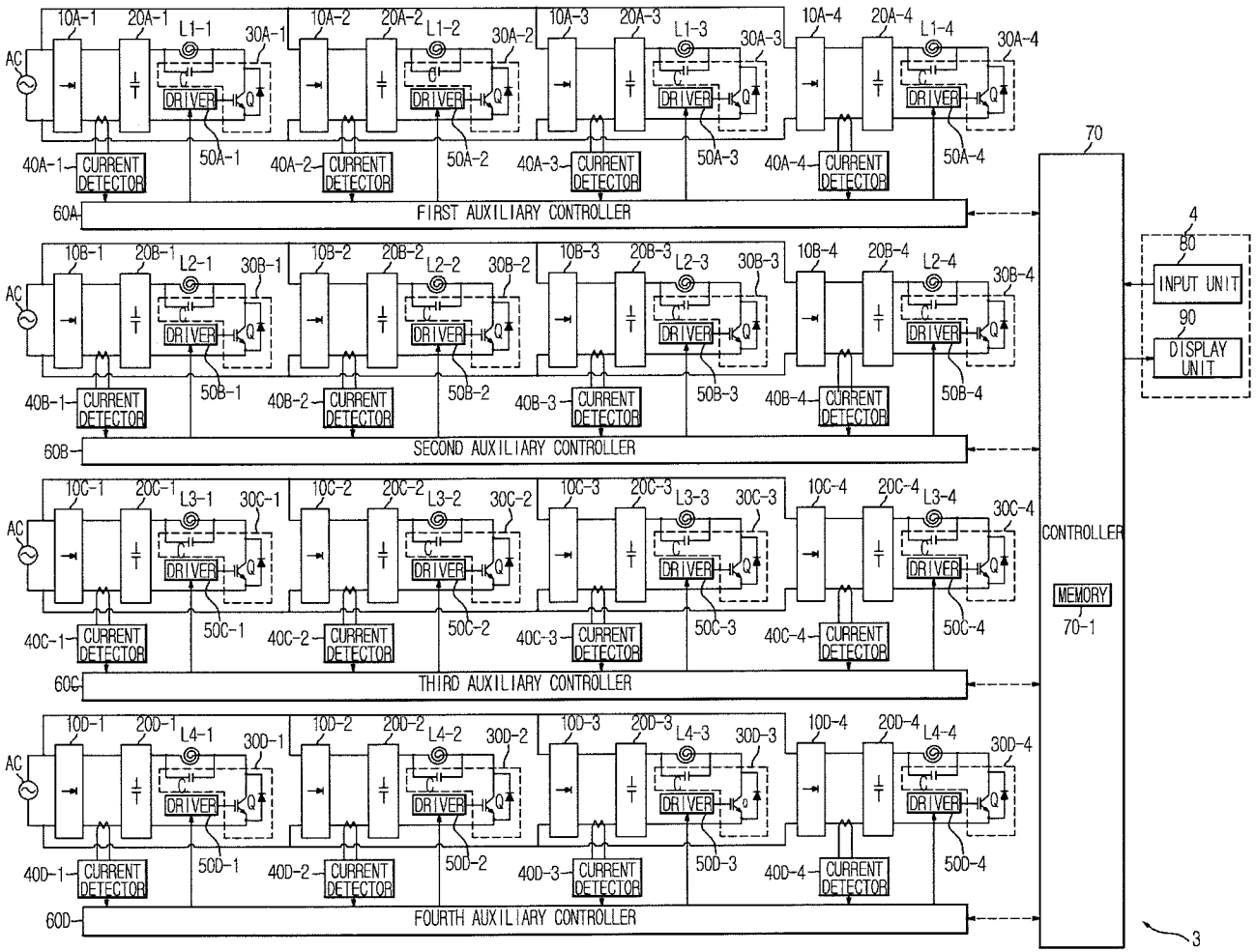
FIG. 2 is a control block diagram illustrating a control device of the induction heating cooker according to the embodiment.

FIG. 2 is a control block diagram illustrating the control device of the induction heating cooker according to the embodiment.

As shown in FIG. 2, the control device 3 includes four auxiliary controllers 60A, 60B, 60C, and 60D, a controller 70, an input unit 80, and a display unit 90.

Each of the auxiliary controllers 60A, 60B, 60C, and 60D is provided to control the driving of four heating coils L grouped as a single control unit among a total of 16 heating coils L disposed in a 4×4 matrix. The controller 70 is provided to control the four auxiliary controllers 60A, 60B, 60C, and 60D.

In this embodiment, each of the auxiliary controllers 60A, 60B, 60C, and 60D is provided for four heating coils L arranged at each row of the heating coils L disposed in the 4×4 matrix. That is, the first auxiliary controller 60A controls the driving of four heating coils L1-1, L1-2, L1-3, and L1-4 arranged at a first row of the 4×4 matrix, the second auxiliary controller 60B controls the driving of four heating coils L2-1, L2-2, L2-3, and L2-4 arranged at a second row of the 4×4 matrix, the third auxiliary controller 60C controls the driving of four heating coils L3-1, L3-2, L3-3, and L3-4 arranged at a third row of the 4×4 matrix, and the fourth auxiliary controller 60D controls the driving of four heating coils L4-1, L4-2, L4-3, and L4-4 arranged at a fourth row of the 4×4 matrix. In reference marks LX-Y (X and Y are natural numbers) denoting the heating coils L, the first number X following the letter "L" indicates a row number, and the second number Y following the letter "L" indicates a column number. For example, reference mark L1-3 indicates a heating coil L arranged at a first row and third column of the 4×4 matrix.

Control constructions to drive the heating coils L1-1 to L1-4, L2-1 to L2-4, L3-1 to L3-4, and L4-1 to L4-4 arranged at the respective rows of the 16 heating coils L disposed in the 4×4 matrix are the same. Hereinafter, therefore, only the control construction to drive the four heating coils L1-1, L1-2, L1-3, and L1-4 arranged at the first row of the 4×4 matrix will be described in detail, and a description of the control constructions to drive the heating coils arranged at the other rows of the 4×4 matrix will be omitted.

As shown in the upper end of FIG. 2, a part of the control device 3 to drive the four heating coils L1-1, L1-2, L1-3, and L1-4 arranged at the first row of the 16 heating coils L disposed in the 4×4 matrix includes rectifiers 10A-1, 10A-2, 10A-3, and 10A-4, smoothers 20A-1, 20A-2, 20A-3, and 20A-4, inverters 30A-1, 30A-2, 30A-3, and 30A-4, current detectors 40A-1, 40A-2, 40A-3, and 40A-4, drivers 50A-1, 50A-2, 50A-3, and 50A-4, and a first auxiliary controller 60A.

The heating coils L1-1, L1-2, L1-3, and L1-4 are independently driven by the respective inverters 30A-1, 30A-2, 30A-3, and 30A-4 provided so as to correspond to the number of the heating coils L1-1, L1-2, L1-3, and L1-4. That is, the heating coil L1-1 is driven by the inverter 30A-1, the heating coil L1-2 is driven by the inverter 30A-2, the heating coil L1-3 is driven by the inverter 30A-3, and the heating coil L1-4 is driven by the inverter 30A-4.

The rectifiers 10A-1, 10A-2, 10A-3 and 10A-4 rectify input alternating current (AC) and output rectified ripple voltage.

The smoothers 20A-1, 20A-2, 20A-3, and 20A-4 smooth the ripple voltage provided from the rectifiers 10A-1, 10A-2, 10A-3, and 10A-4 and output uniform direct voltage obtained by smoothing.

The inverters 30A-1, 30A-2, 30A-3, and 30A-4 include switching elements Q to switch the direct voltage provided from the smoothers 20A-1, 20A-2, 20A-3, and 20A-4 according to a switching control signal of the drivers 50A-1, 50A-2, 50A-3, and 50A-4 and to provide resonance voltage to the heating coils L1-1, L1-2, L1-3, and L1-4 and resonance condensers C connected in parallel to the respective heating coils L1-1, L1-2, L1-3, and L1-4 to continuously resonate with the respective heating coils L1-1, L1-2, L1-3, and L1-4 by input voltage.

When the switching elements Q of the inverters 30A-1, 30A-2, 30A-3, and 30A-4 are electrically conducted, the heating coils L1-1, L1-2, L1-3, and L1-4 and the resonance condensers C form a parallel resonance circuit. When the switching elements Q are cut off, on the other hand, current flows in the heating coils L1-1, L1-2, L1-3, and L1-4 in the direction opposite to high-frequency current flowing during the electrical conduction of the switching elements Q while charges, which were charged in the resonance condensers C during electrical conduction of the switching elements Q, are discharged.

The current detectors 40A-1, 40A-2, 40A-3, and 40A-4 are connected between the rectifiers 10A-1, 10A-2, 10A-3, and 10A-4 and the smoothers 20A-1, 20A-2, 20A-3, and 20A-4, respectively. The current detectors 40A-1, 40A-2, 40A-3, and 40A-4 detect values of current flowing in the heating coils L1-1, L1-2, L1-3, and L1-4 to detect the heating coils L1-1, L1-2, L1-3, and L1-4 on which the container P is placed and provide the detected current values to the first auxiliary controller 60A. The current detectors 40A-1, 40A-2, 40A-3, and 40A-4 are provided so as to correspond to the number of the heating coils L1-1, L1-2, L1-3, and L1-4, respectively, and include converter sensors (CT sensors).

The drivers 50A-1, 50A-2, 50A-3, and 50A-4 output a driving signal to the switching elements Q of the inverters 30A-1, 30A-2, 30A-3, and 30A-4 according to a control signal of the first auxiliary controller 60A to turn the switching elements Q on or off.

The first auxiliary controller 60A sends a control signal to the respective drivers 50A-1, 50A-2, 50A-3, and 50A-4 according to a control signal of the controller 70 to control the driving of the respective heating coils L1-1, L1-2, L1-3, and L1-4. Also, the first auxiliary controller 60A receives the values of current flowing in the heating coils L1-1, L1-2, L1-3, and L1-4, detected by the respective current detectors 40A-1, 40A-2, 40A-3, and 40A-4 and sends the received current values to the controller 70.

The controller 70 controls overall operation of the induction heating cooker. The controller 70 is communicatively connected to the first to fourth auxiliary controllers 60A, 60B, 60C, and 60D to control the driving of the heating coils L1-1 to L1-4, L2-1 to L2-4, L3-1 to L3-4, and L4-1 to L4-4 arranged at the respective rows of the 4×4 matrix and sends a control signal to the respective auxiliary controllers 60A, 60B, 60C, and 60D to control the driving of the heating coils L1-1 to L1-4, L2-1 to L2-4, L3-1 to L3-4, and L4-1 to L4-4.

The controller 70 controls the operations of the inverters 30A-1 to 30A-4, 30B-1 to 30B-4, 30C-1 to 30C-4, and 30D-1 to 30D-4 so that a process of supplying high-frequency powers to the respective heating coils is alternately performed according to a container position detection command input through the input unit 80 and detects heating coils L on which the container P is placed using the values of current flowing in the respective heating coils L detected by the current detectors 40A-1 to 40A-4, 40B-1 to 40B-4, 40C-1 to 40C-4, and 40D-1 to 40D-4.

To perform a cooking operation, the controller 70 controls the operations of the inverters 30A-1 to 30A-4, 30B-1 to 30B-4, 30C-1 to 30C-4, and 30D-1 to 30D-4 so that high-frequency powers corresponding to power levels of the heating coils L input through the input unit 80 are supplied to the heating coils P on which the container is determined to be placed.

The controller 70 includes a memory 70-1 provided therein. The memory 70-1 stores reference values (predetermined values) used to determine whether a container P is placed on the heating coils L of the induction heating cooker.

The input unit 80 may include an ON/OFF button to turn power on or off, a detection button to input a container position detection command, a button to input information on the container P, a +/− button to adjust the power levels of the heating coils L, and a start/pause button to start or pause a cooking operation, for example.

The display unit 90 displays position information of the heating coils L on which the container P is placed and the power levels of the heating coils L input by a user through the +/− button.

The input unit 80 and the display unit 90 may be integrated. That is, the control panel 4 may display user input items in the form of a touch panel and the displayed portion may be touched by a user so that user intention is input to the controller 70 as an electrical signal. Embodiments of the input unit will be described below in detail with reference to FIGS. 8A to 9B.

In this embodiment, each of the auxiliary controllers 60A, 60B, 60C, and 60D is provided for four heating coils L arranged at each row of the heating coils L disposed in the 4×4 matrix and the controller 70 is provided to control the auxiliary controllers 60A to 60D. Alternatively, auxiliary controllers configured in different forms may be provided or only a single controller may control 16 coils without auxiliary controllers.

Hereinafter, a control method of the induction heating cooker when a plurality of containers P is placed on a single heating coil L will be described with reference to FIGS. 4 to 7.

The induction heating cooker according to the embodiment heats a container P regardless of where the container P is placed on the cooking plate 2. However, the induction heating cooker detects whether the container P is placed on the heating coils L but may not detect the number of containers P placed on the heating coils L and percentage of the containers P occupying the heating coils L. When a plurality of containers P is placed on a single heating coil L, therefore, the containers P may be recognized as a single container P and the respective containers P may not be heated using different powers. That is, user intention (to provide different powers to a plurality of containers P placed on a single heating coil L) may not be reflected properly. Hereinafter, a case in which two containers P are placed on a heating coil as shown in FIG. 4 will be described by way of example.

Figure 4:
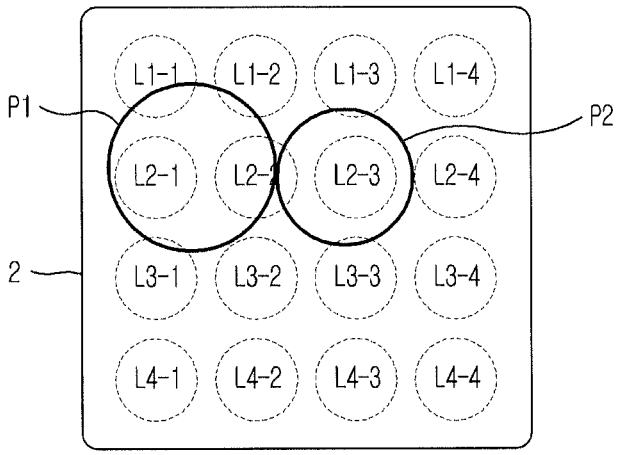
FIG. 4 is a plan view illustrating two containers placed on a heating coil of the induction heating cooker according to the embodiment.

FIG. 4 is a plan view illustrating two containers placed on a heating coil of the induction heating cooker according to the embodiment.

As shown in FIG. 4, two containers P1 and P2 are placed on the cooking plate 2. Also, the containers P1 and P2 occupy several heating coils L. In particular, the containers P1 and P2 jointly occupy a heating coil L2-2.

Hereinafter, the operation of the induction heating cooker according to the embodiment to heat the containers P1 and P2 will be described.

In FIG. 4, the containers P1 and P2 may occupy the heating coil L2-2 as follows. As an example, a container P2 is placed on the heating coil L2-2 while another container P1 is heated. As another example, the containers P1 and P2 are placed as shown in FIG. 4 before the induction heating cooker is turned on, or after the induction heating cooker is turned on but before a detection process is performed.

First, a control process of the induction heating cooker when a plurality of containers P is placed on a heating coil will be described with reference to FIGS. 4 and 5.

Figure 5:
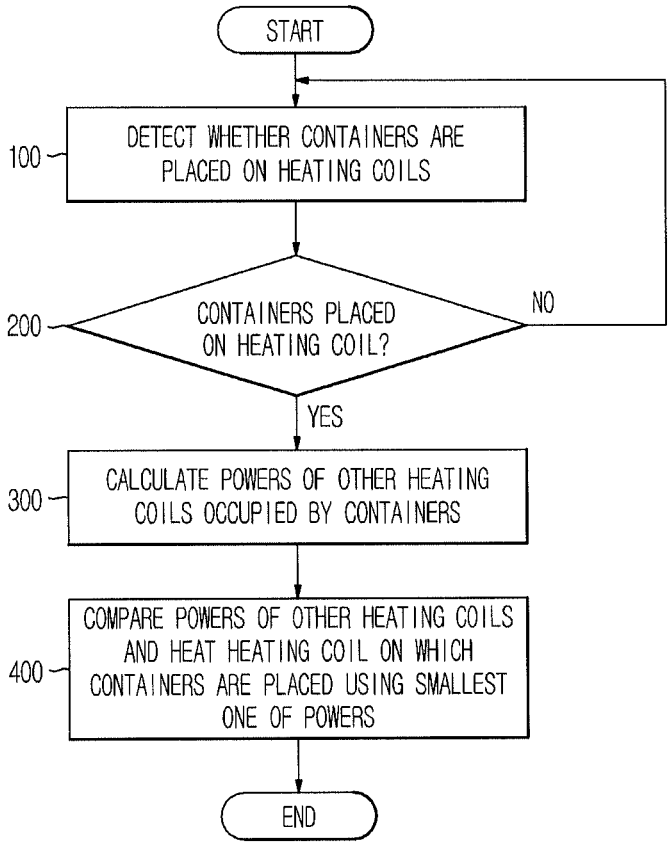
FIG. 5 is a flow chart illustrating a control method of the induction heating cooker according to the embodiment when two containers are placed on a heating coil of the induction heating cooker.

FIG. 5 is a flow chart illustrating a control method of the induction heating cooker according to the embodiment when two containers P1 and P2 are placed on a heating coil of the induction heating cooker.

Figure 6:
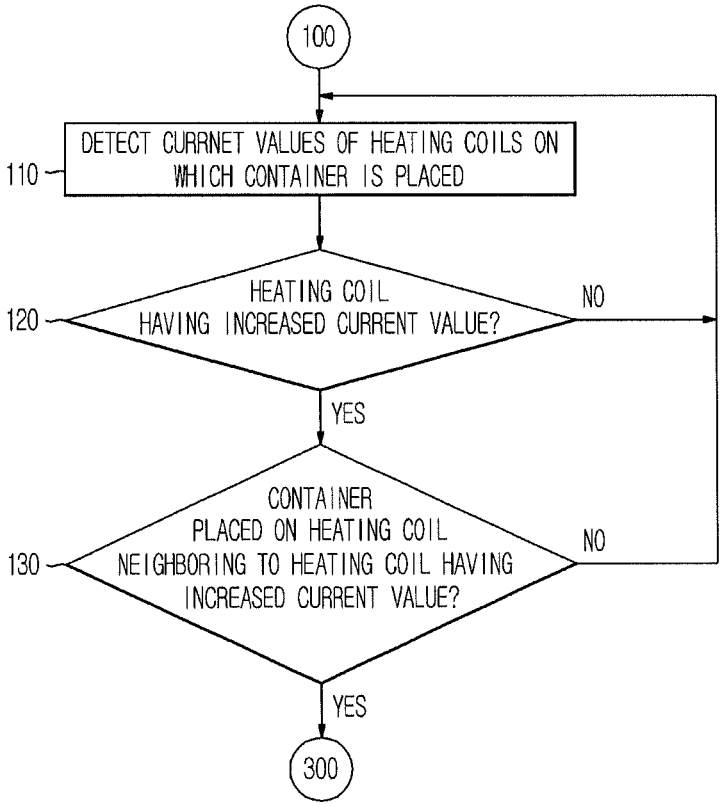
FIG. 6 is a flow chart illustrating a control method of the induction heating cooker according to the embodiment to determine whether two containers are placed on a heating coil of the induction heating cooker.

First, it is detected whether containers P are placed on heating coils L (100). The detection process may be controlled automatically by the controller 70 at a predetermined time interval or may be controlled by the controller according to a signal from the input unit 80 input by a user. Subsequently, it is determined whether a plurality of containers P is placed on a single heating coil L (200). It may be determined whether a plurality of containers P is placed on a single heating coil L in various ways, an example of which is shown in FIG. 6.

If it is determined that the containers P are placed on the single heating coil L, the controller 70 calculates powers of the other heating coils occupied by the containers P (300). That is, in an example shown in FIG. 4, the controller 70 calculates powers of the heating coils L1-1, L1-2, L2-1, and L3-1 on which the container P1 is placed and powers of the heating coils L1-3, L2-3, and L3-3 on which the container P2 is placed, excluding the heating coil L2-2 on which the containers P are placed. Here, the powers applied to the heating coils exclusively occupied by the container P1 are the same. Also, the powers applied to the heating coils exclusively occupied by the container P2 are the same.

If it is determined that the containers P are placed on the single heating coil L, the procedure returns to the process of detecting whether the container P is placed on the heating coil L (Operation 100).

Subsequently, the power of the heating coil L2-2 on which the containers P1 and P2 are placed is adjusted based on the calculated powers of the other heating coils. Here, the power of the heating coil L2-2 may be adjusted in various ways. As an example, the heating coil L2-2 may be heated using a smallest one of the powers of the other heating coils (400), which is applied to prevent any one of the containers P from being burned when the difference between the comparative power values is large. As another example, the comparative power values may be averaged, and the average value may be used as the power of the heating coil L2-2, which may be useful when the difference between the comparative power values is small. Alternatively, all of the comparative power values may be neglected and no power may be applied to the heating coil L2-2.

Hereinafter, a process of determining whether a plurality of containers P is placed on a single heating coil will be described with reference to FIG. 6. In the embodiment of FIG. 6, when a container P is placed on a heating coil and then another container P is further placed on the heating coil to occupy the heating coil occupied by the first container, it is determined that a plurality of containers P is placed on a single heating coil. FIG. 6 is a flow chart illustrating a control method of the induction heating cooker according to the embodiment to determine whether two containers P1 and P2 are placed on a heating coil of the induction heating cooker.

A container P2 is placed on the heating coil L2-2 while another container P1 is heated, for example, as shown in FIG. 4 (the containers P1 and P2 may be placed in reverse order).

First, current values of heating coils on which the containers P are placed are detected (110).

Even in a state in which the container P1 is heated, the current detectors 40 continuously detect values of current flowing in the heating coils (in FIG. 4, the heating coils L1-1, L1-2, L2-1, L2-2, and L3-1) occupied by the container P1.

Subsequently, it is determined whether there is a heating coil L having an increased current value (120). That is, as shown in FIG. 4, when the container P2 is further placed, the current detector 40 detects the increased current value of the heating coil L2-2 and informs the controller 70 that the heating coil L2-2 has the increased current value.

Figure 7:
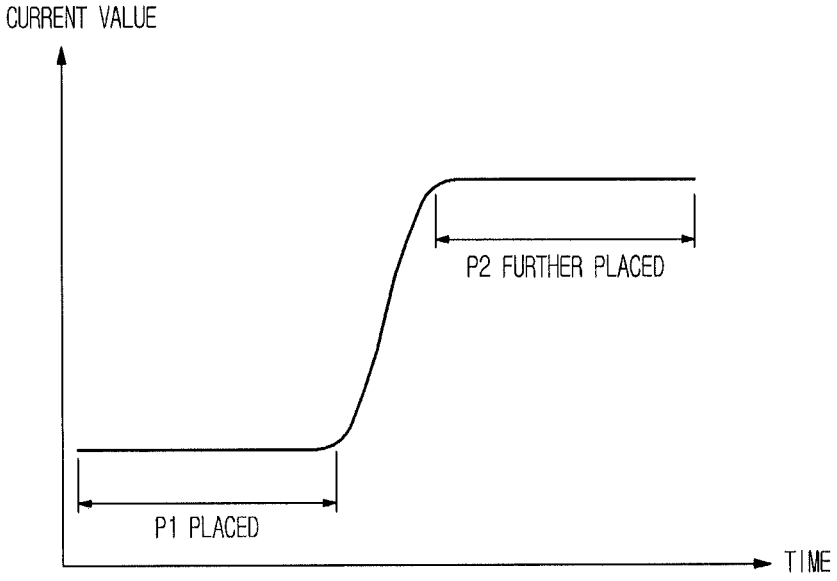
FIG. 7 is a graph illustrating change in current value of a heating coil when a container is placed on the heating coil and then another container is further placed on the heating coil.

The increase in current value of the heating coil L2-2 is shown in the graph of FIG. 7.

FIG. 7 is a graph illustrating change in current value of a heating coil when a container is placed on the heating coil and then another container is further placed on the heating coil.

The controller 70, informed that the heating coil L2-2 has the increased current value, determines whether a container P is placed on heating coils L neighboring to the heating coil L2-2 (130). If it is determined that the container P is not placed on the neighboring heating coils, which means that the current value is increased according to simple movement of the container P1, the procedure returns to the operation to detect current values of heating coils on which the containers P are placed.

If it is determined that the container P is placed on the neighboring heating coils, which means that a plurality of containers (in this case, P1 and P2) is placed on a single heating coil L2-2, the procedure advances to an operation to adjust the power of the heating coil L2-2 (Operation 300).

Here, determining whether the container P is placed on the neighboring heating coils entails detecting current values of the heating coils L1-2, L1-3, L2-3, L3-2 and L3-3 neighboring to the heating coil L2-2 having the increased current value to determine whether the container P is placed on the neighboring heating coils.

Hereinafter, a control process of the induction heating cooker when a plurality of containers (in this case, P1 and P2) is placed as shown in FIG. 4 before the induction heating cooker is turned on, or after the induction heating cooker is turned on but before a detection process is performed will be described.

That is, if the two containers P1 and P2 are placed on a single heating coil L2-2 before power-on of the induction heating cooker or before a detection process, the controller determines that a container P is placed on the heating coils L2-1, L2-2 and L2-3 (the other heating coils L1-1 and L1-3 are neglected since the heating coils occupy a small area).

At this time, the controller 70 may not recognize that the containers P1 and P2 are placed on the cooking plate 2. Consequently, recognition of the controller 70 is performed through user input. First, the number of containers P placed on the cooking plate 2 is input through the input unit 80. User input may be performed in various ways, for example using a manipulation key or by touch.

After the number of the containers P is input, the shape or occupying pattern of the containers P is input through the input unit 80, for example, as shown in FIGS. 8A to 9B. FIGS. 8A to 9B are plan views illustrating input units of the induction heating cooker according to the embodiment.

FIGS. 8A to 9B show that possible shapes or occupying patterns of the containers P according to the number of the containers P input by the user are displayed so that the user selects one of the shapes or occupying patterns of the containers P similar to actual containers P. That is, since the controller 70 of the induction heating cooker does not recognize the number of the containers P placed on the cooking plate 2, the occupying patterns or shapes of the containers P which may be most frequently used according to the number of the containers P input by the user are displayed and the user selects the occupying pattern or shape of the containers P similar to actual containers P so that the controller 70 recognizes the number and shape of the containers P.

Figure 8A:
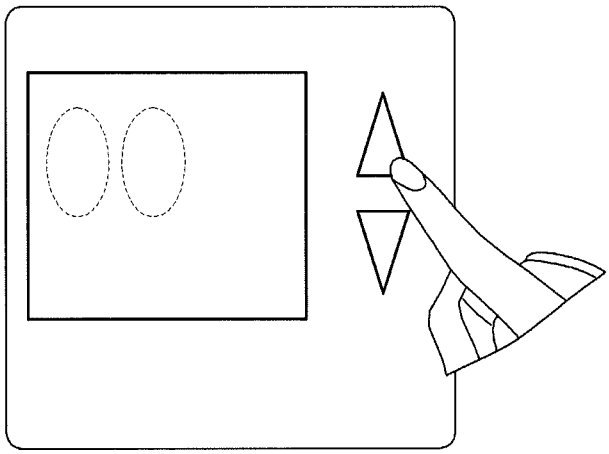
FIGS. 8A, 8B, 8C, 9A and 9B are plan views illustrating input units of the induction heating cooker according to the embodiment.
Figure 8B:
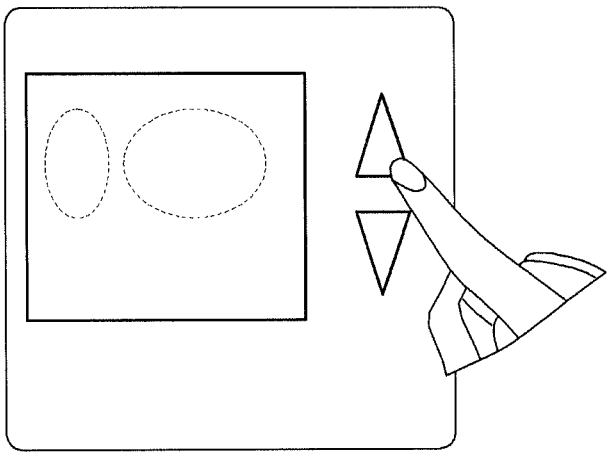
Figure 8C:
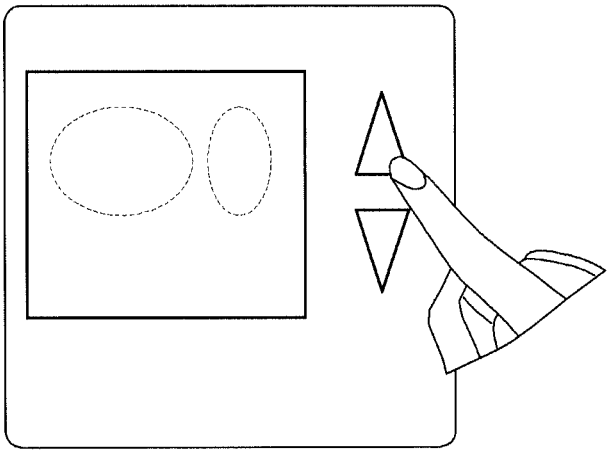

FIGS. 8A to 8C show the number of cases in which two containers P1 and P2 may be placed. Since recognizing shapes and occupying patterns of actual containers, the user selects one of the displayed shapes of occupying patterns.

Figure 9A:
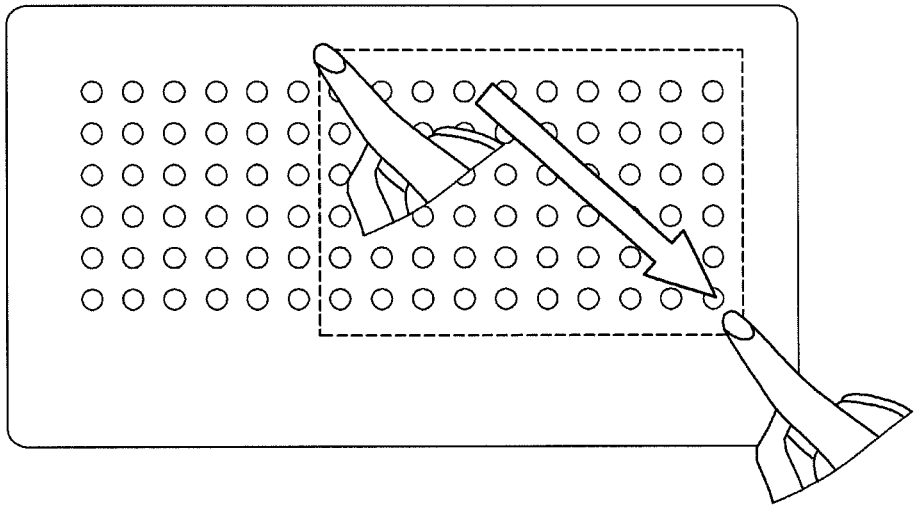

FIG. 9A shows that the user directly sets the containers P by dragging areas of the containers P. That is, the user inputs areas of the containers P by directly dragging areas occupied by the two containers P1 and P2 on a screen displayed on the display unit 90.

In a case in which a plurality of containers P1 and P2 is placed on a single heating coil L before power-on or a plurality of containers P1 and P2 is simultaneously placed on a single heating coil L as described above, the controller 70 recognizes that the plurality of containers P1 and P2 is placed on the single heating coil L according to user input of information on the containers P.

Figure 9B:
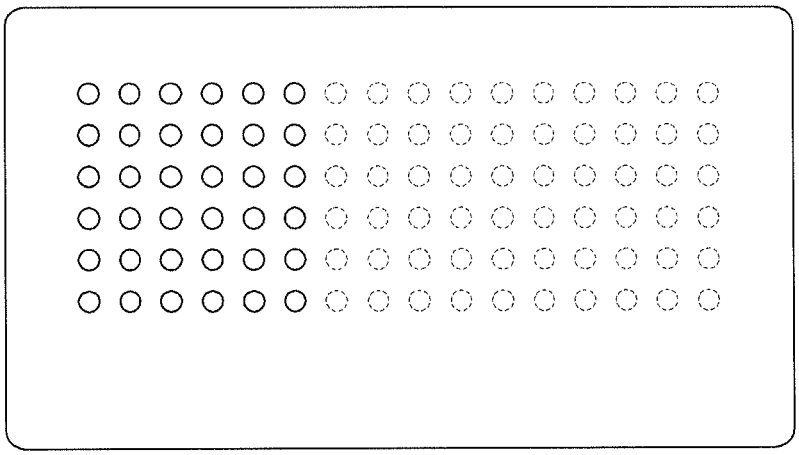

FIG. 9B shows occupied areas of the containers P displayed on the display unit 90 after the user inputs the occupied areas of the containers P by a user drag operation as shown in FIG. 9A. The user drag operation shown in FIG. 9A may be performed once or more and a state shown in FIG. 9B may be displayed on the display unit 90 a predetermined time after the user drag operation is performed. Also, whenever the user drag operation is performed, the occupied areas of the containers corresponding to the user drag operation may be displayed on the display unit 90.

As is apparent from the above description, cooking using a plurality of containers is stably performed based on user intention even when cooking conditions of the containers placed on a heating coil differ.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An induction heating cooker comprising:

a plurality of heating coils disposed below a cooking plate; and a controller to determine whether a plurality of containers are placed on a common heating coil of the plurality of heating coils, and, when the plurality of containers are placed on the common heating coil, to adjust a power of the common heating coil based on powers of other heating coils of the plurality of heating coils that are occupied by the plurality of containers.

2. The induction heating cooker according to claim 1, further comprising:

current detectors to detect values of current flowing in the plurality of heating coils, wherein the controller determines whether the plurality of containers are placed on the common heating coil based on the current values detected by the current detectors.

3. The induction heating cooker according to claim 2, wherein the controller controls the current detectors to detect the values of current flowing in the plurality of heating coils at a predetermined time interval and determines whether the plurality of containers are placed on the common heating coil based on change of the values of current flowing in the plurality of heating coils.

4. The induction heating cooker according to claim 3, wherein, upon determining that the common heating coil has an increased current value and that a container is placed on a heating coil neighboring to the common heating coil, the controller determines that the plurality of containers are placed on the common heating coil.

5. The induction heating cooker according to claim 1, wherein the controller drives the common heating coil using a smallest one of the powers of the other heating coils of the plurality of heating coils that are occupied by the plurality of containers.

6. The induction heating cooker according to claim 1, wherein the controller drives the common heating coil using an average of the powers of the other heating coils of the plurality of heating coils that are occupied by the plurality of containers.

7. The induction heating cooker according to claim 5, wherein the controller drives the common heating coil using a second smallest one of the powers of the other heating coils of the plurality of heating coils that are occupied by the plurality of containers when the container driven using the smallest power is removed.

8. The induction heating cooker according to claim 2, further comprising:

an input unit to allow information on a plurality of containers placed on the cooking plate to be input, wherein the controller controls the current detectors to detect the values of current flowing in the respective heating coils at a predetermined time interval and determines whether the containers are placed on one of the heating coils based on the information on the containers input through the input unit when the containers are placed on one of the heating coils before power-on or when the containers are placed on one of the heating coils within the predetermined time interval.

9. The induction heating cooker according to claim 8, wherein the information on the containers comprises a number, position, or shape of the containers.

10. The induction heating cooker according to claim 9, wherein the controller controls the input unit to display a position or shape used most frequently according to the number of the containers.

11. The induction heating cooker according to claim 8, wherein the input unit allows the information on the containers placed on the cooking plate to be input by a user drag operation.

12. A control method of an induction heating cooker, having a cooking plate and a plurality of heating coils, to heat a container regardless of where the container is placed on the cooking plate, the control method comprising:

determining whether a plurality of containers are placed on a common heating coil of the plurality of heating coils; and upon determining that the plurality of containers are placed on the common heating coil, adjusting a power of the common heating coil based on powers of other heating coils of the plurality of heating coils that are occupied by the plurality of containers.

13. The control method according to claim 12, wherein the determining whether the plurality of containers are placed on the common heating comprises detecting values of current flowing in the plurality of heating coils at a predetermined time interval and determining whether the plurality of containers are placed on the common heating coil based on change of the detected current values.

14. The control method according to claim 13, wherein the determining whether the containers are placed on the common heating coil comprises, when the common heating coil has an increased current value and a container is placed on a heating coil neighboring to the common heating coil, determining that the plurality of containers are placed on the common heating coil.

15. The control method according to claim 12, wherein the adjusting the power of the common heating coil comprises driving the common heating coil using a smallest one of the powers of the other heating coils of the plurality of heating coils that are occupied by the plurality of containers.

16. The control method according to claim 12, wherein the adjusting the power of the common heating coil comprises driving the common heating coil using an average of the powers of the other heating coils of the plurality of heating coils that are occupied by the plurality of containers.

17. The control method according to claim 15, wherein the driving the common heating coil using the smallest one of the powers of the other heating coils of the plurality of heating coils that are occupied by the plurality of containers comprises driving the common heating coil using a second smallest one of the powers of the other heating coils of the plurality of heating coils that are occupied by the plurality of containers when the container driven using the smallest power is removed.

18. The control method according to claim 12, comprising:

allowing information on a plurality of containers placed on the cooking plate to be input; and determining whether the containers are placed on one of the heating coils based on the input information on the containers when the containers are placed on one of the heating coils before power-on or when the containers are simultaneously placed on one of the heating coils.

19. The control method according to claim 18, further comprising displaying a position or shape used most frequently according to a number of the containers.

20. The control method according to claim 18, wherein the allowing the information on the containers placed on the cooking plate to be input comprises allowing the information on the containers placed on the cooking plate to be input by a user drag operation.

* * * * *